US006637300B2

(12) United States Patent
Wu

(10) Patent No.: US 6,637,300 B2
(45) Date of Patent: Oct. 28, 2003

(54) REVERSIBLE ADJUSTABLE WRENCH

(76) Inventor: Arthur Wu, No. 22, Alley 28, Lane 360, Chung Shan Rd., She Kou Village, Shen Kang Hsiang, Taichung Hsien (TW)

( * ) Notice: Subject to any disclaimer, the term of this patent is extended or adjusted under 35 U.S.C. 154(b) by 0 days.

(21) Appl. No.: 10/078,453

(22) Filed: Feb. 21, 2002

(65) Prior Publication Data

US 2003/0154830 A1 Aug. 21, 2003

(51) Int. Cl.[7] ..... B25B 13/00
(52) U.S. Cl. ..... 81/186; 81/179; 81/170
(58) Field of Search ..... 81/186, 185.2, 81/180.1, 179, 60, 61, 165, 170

(56) References Cited

U.S. PATENT DOCUMENTS 925,522 A * 6/1909 Stalker ..... 81/186
2,630,037 A * 3/1953 McComb ..... 81/179
2,700,315 A * 1/1955 Hermanson ..... 81/186
2,721,493 A * 10/1955 Bergland ..... 81/179
4,070,933 A * 1/1978 Macintosh ..... 81/185.1
4,449,430 A * 5/1984 Nakamura et al. ..... 81/186
4,706,528 A * 11/1987 Inoue ..... 81/129

* cited by examiner

*Primary Examiner*—D. S. Meislin
(74) *Attorney, Agent, or Firm*—Browdy and Neimark, P.L.L.C.

(57) ABSTRACT

A reversible adjustable wrench comprises a handle having a fixed jaw and a guiding slot at an end of the handle. The fixed jaw has two slots at lateral sides thereof, each of which defines two stopping potion at lateral sidewalls thereof. A movable jaw has an end thereof slidable received in the guiding slot of the handle. An adjusting worm is to drive the movable jaw moving toward and away from the fixed jaw. A rotatable device has two body potions received in the slots. A pin passes through the body potions and the fixed jaw for pivoting the rotatable device at the fixed jaw. The rotatable device has a holding potion, which connects to ends of the body potions, facing the movable jaw, and an elastic member has an end being against the fixed jaw and the other end being against the rotatable device to drive the holding potion of the rotatable device turning to the tip end of the fixed jaw for the rotatable being against the topping potion of the fixed jaw, such that the holding potion of the rotatable device can be turned to the proximal end of the fixed jaw.

4 Claims, 6 Drawing Sheets

REVERSIBLE ADJUSTABLE WRENCH

FIELD OF THE INVENTION

The present invention related to a wrench, and more particularly to a reversible adjustable wrench.

BACKGROUND OF THE INVENTION

In prior art, when use an adjustable wrench to turn a nut (or a bolt), it has to disengage the nut after turning an angle. And then, turns the adjustable wrench returning to the initial angle and reengages the adjustable wrench to the nut again for driving the nut to turn. User has to repeat the procedures described above to turn tight or to turn loose the nut.

FIG. 1 shows a conventional reversible adjustable wrench 90, which is capable of turning a nut without having to disengage and reengage the nut. The adjustable wrench 90 disposes two round channels 911 and 921 at the fixed jaw 91 and the movable jaw 92 respectively. Two racket rods 93 and 94, which have teeth faces 931 and 941 on outer ends thereof, are slidable received in the round channels 911 and 921 respectively. Two elastic members 95 and 96 are disposed at the fixed jaw 91 and the movable jaw 92 respectively for pushing the racket rods 93 and 94 respectively.

In use, user drives the movable jaw 92 moving, toward the fixed jaw 91 to make the teeth faces 931 and 941 of the fixed jaw 91 and the movable jaw 92 holding a nut N. After that, user can turn the adjustable wrench 90 clockwise to drive the nut N to turn. On the contrary, when user turns the adjustable wrench 90 counterclockwise, the nut N will drive the racket rods 93 and 94 sliding into the round channels 911 and 921, such that the adjustable wrench 90 can turn backward but without driving the nut N to turn. Thus, the adjustable wrench 90 can turn a nut or a bolt without having to disengage and reengage the nut or the bolt repeatedly.

Hereunder are the disadvantages of the conventional reversible adjustable wrench 90 as described above:

1. The adjustable wrench 90 defines the teeth faces 931 and 941 of the racket rods 93 and 94 to hold the edges of the nut N. It will easy to damage the nut N when turning.

2. The adjustable wrench 90 is to turn the nuts in a range of different dimensions. It will have nuts of specific dimensions, which cannot be held by the teeth faces 931 and 941 stably.

3. If user drives the movable jaw 92 too close to the fixed jaw 91, the racket rods 93 and 94 will be pushed into the round channels 911 and 921 and the fixed jaw 91 and the movable jaw 92 will, be against the nut N directly. Thus, the adjustable wrench 90 will loose the capability of reversible turning the nut.

SUMMARY OF THE INVENTION

The primary object of the present invention is to provide a reversible adjustable wrench, which has the capability of reversible turning a nut or a bolt but without the drawbacks as described above.

According to the objective of the present invention, an adjustable wrench comprises a handle having a fixed jaw and a guiding slot at an end of the handle. The fixed jaw has at least one stopping portion thereon. A movable jaw has an end thereof slidable received in the guiding slot of the handle. An adjusting worm is to drive the movable jaw moving toward and away from the fixed jaw. A rotatable device is pivoted at the fixed jaw to be turned relative to the fixed jaw. The rotatable device has a holding portion facing the movable jaw, and an elastic member is disposed between the fixed jaw and the rotatable device to drive the holding portion of the rotatable device turning to the tip end of the fixed jaw for the rotatable being against the topping portion of the fixed jaw, such that the holding portion of the rotatable device only can be turned to the proximal end of the fixed jaw.

DETAIL DESCRIPTION OF THE INVENTION

Figure 1:
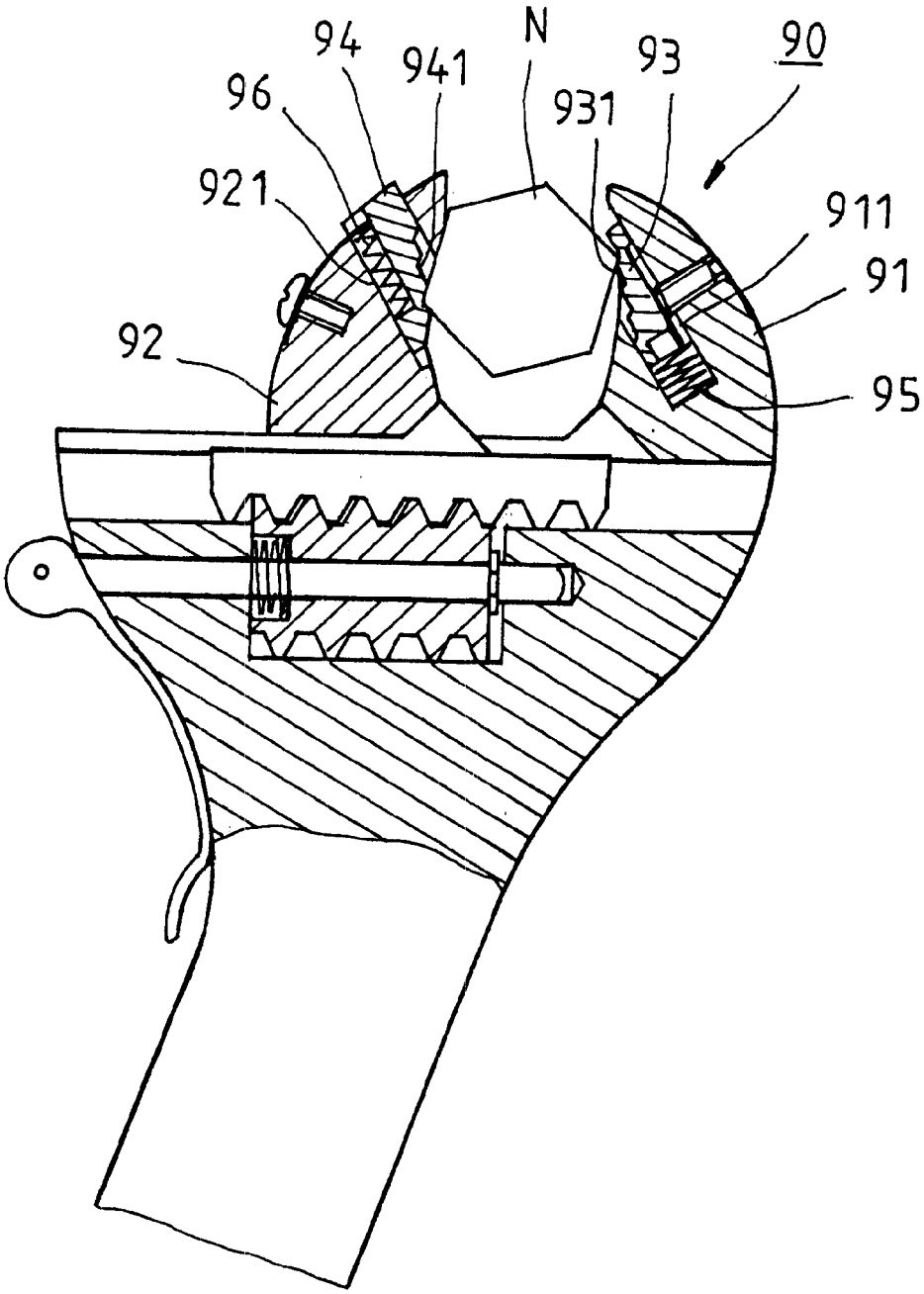
FIG.1 PRIOR ART
FIG. 1 is a section view of a prior art.
Figure 2:
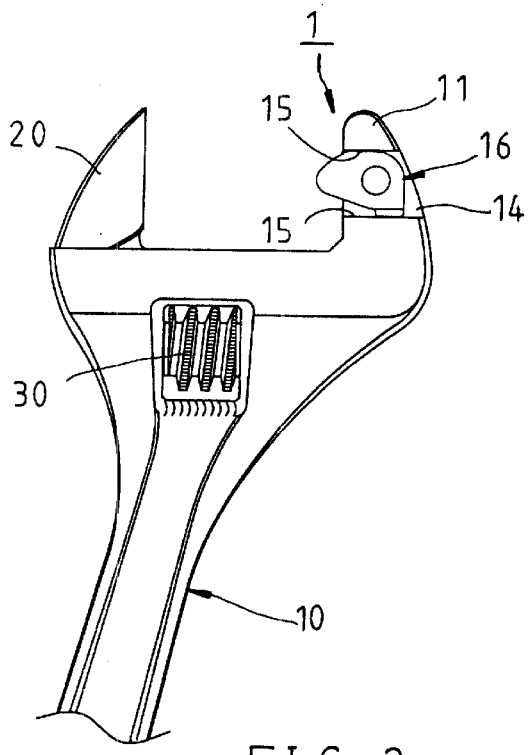
FIG. 2 is a front view of a first prefer embodiment of the present invention.
Figure 3:
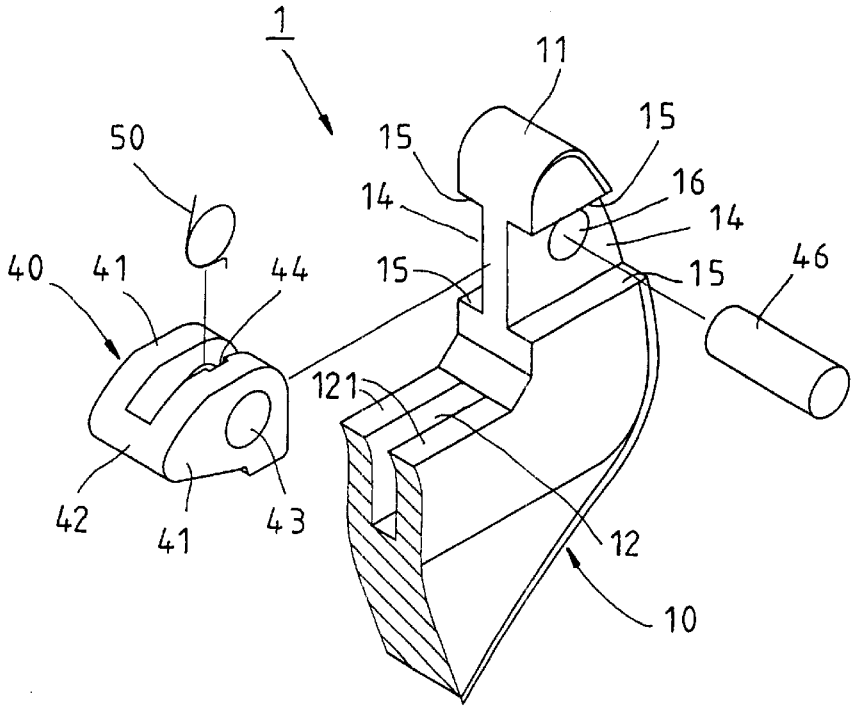
FIG. 3 is partial perspective view of the first prefer embodiment of the present invention, showing the rotatable device mounted on the fixed jaw.

Please refer to FIG. 2 and FIG. 3, the first prefer embodiment of the present invention provides a reversible adjustable wrench 1 comprises:

A handle 10 has a fixed jaw 11 at an end thereof and a guiding slot 12 beside the fixed jaw 11. The handle 10 defines two sliding surfaces 121 at topside of the guiding slot 12.

A movable jaw 20 has an end slidable received in the guiding slot 12 of the handle 10.

An adjusting worm 30 is pivoted on the handle 10 for driving the movable jaw 20 to slide toward or away from the fixed jaw 11.

The elements as described above are the same as the conventional adjustable wrench. The main characters of the present invention will be described hereunder.

The fixed jaw 11 has two slots 14 at opposite sides thereof respectively. The sidewalls of the slots 14 are defined as stopping portions 15. The fixed jaw 11 further has an axial hole 16, which has opening ends at bottom sides of the slots 14 respectively.

A rotatable device 40 has two parallel body portions 41 and a holding portion 42 connecting to ends of the body portions 41. Each body portions 41 has an opening 43. One body portion 41 has a hollow portion 44 at interior side thereof around the opening 43. The rotatable device 40 is disposed on the fixed jaw 11 of the handle 10 with the body portions 41 being respectively received in the slots 14 and with the holding portion 43 facing the movable jaw 20. A pin 46 inserts into the openings 43 of the body portions 41 and the axial hole 16 of the fixed jaw 11 to pivot the rotatable device 40 on the fixed jaw 11.

An elastic member 50, which is a torsional spring in the present embodiment, is disposed in the hollow portion 44 of the rotatable device 40. The elastic member 50 has an end thereof fastening to the rotatable and the other end thereof being against the stopping portion 15 of the fixed jaw 11. Thus, the initial position of the rotatable device 40 is that the body portions 41 are against the stopping portions 15 of the fixed jaw 11 with the holding portion 42 engaged against the tip end of the fixed jaw 11. The rotatable device 40 can be turned to the proximal end of the fixed jaw. When the external force is gone, the elastic member 50 will return the rotatable device 40 to the initial position.

Figure 4:
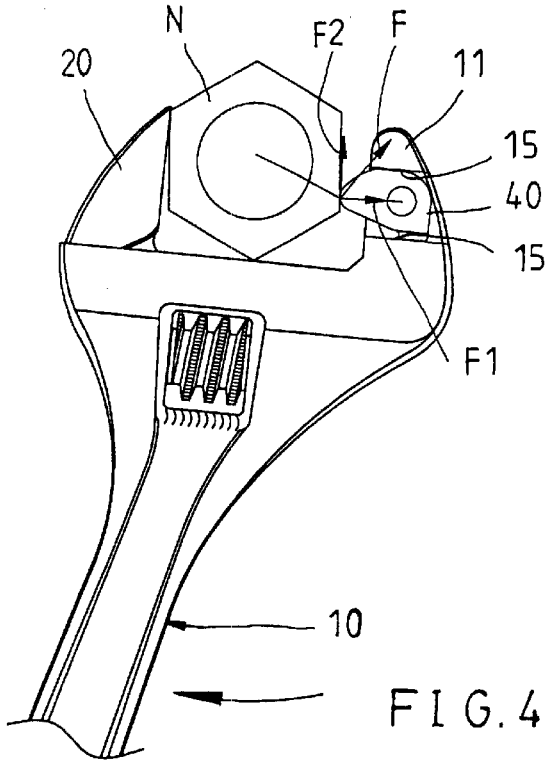
FIG. 4 is a front view of the first prefer embodiment of the present invention, showing force of the nut exerted on the rotatable device when turning the wrench forward.

In use, please refer to FIG. 4, user turns the adjusting worm 30 to drive the movable jaw 20 and the holding portion 42 of the rotatable device 40 against the opposite sides of a nut N (or a bolt). The user only needs to turn the adjusting worm 30 till he/she cannot turn it further until the adjustable wrench 1 of the present invention holds the nut N fixedly. This is the same as operating a conventional adjustable wrench.

Now the user can turn the adjustable wrench 1 of the present invention clockwise to drive the nut N to turn. FIG. 4 shows the nut N exerting a force F on the rotatable device 40 when turning clockwise. In analyzing the force F, it can be resolved into a horizontal component F~ and a vertical component F2. The pin 46 will oppose $F_1$. $F_2$ provides the rotatable device 40 a clockwise moment, which is opposed by the stopping portions 15 being against the rotatable device 40. Thus, the rotatable device 40 is fixed in turning to drive the nut N to turn.

Figure 5:
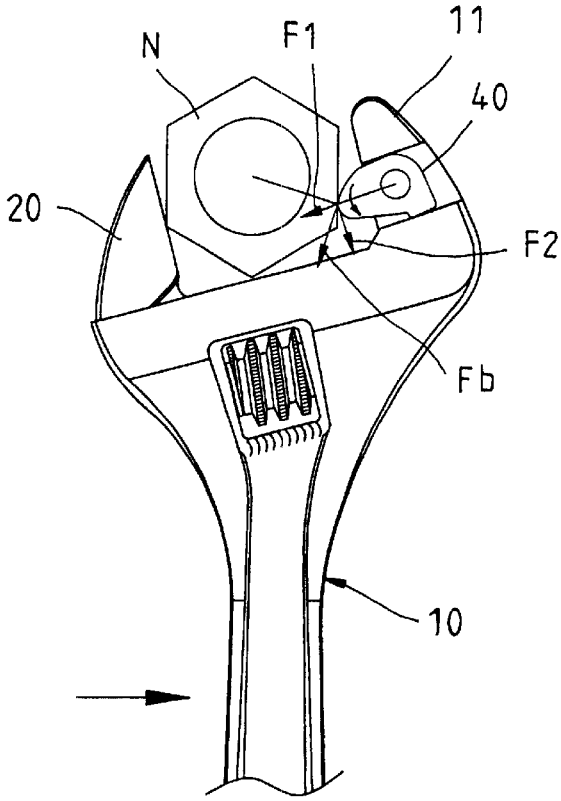
FIG. 5 is a front view of the first prefer embodiment of the present invention, showing force of the nut exerted on the rotatable device when turning the wrench backward.
Figure 6:
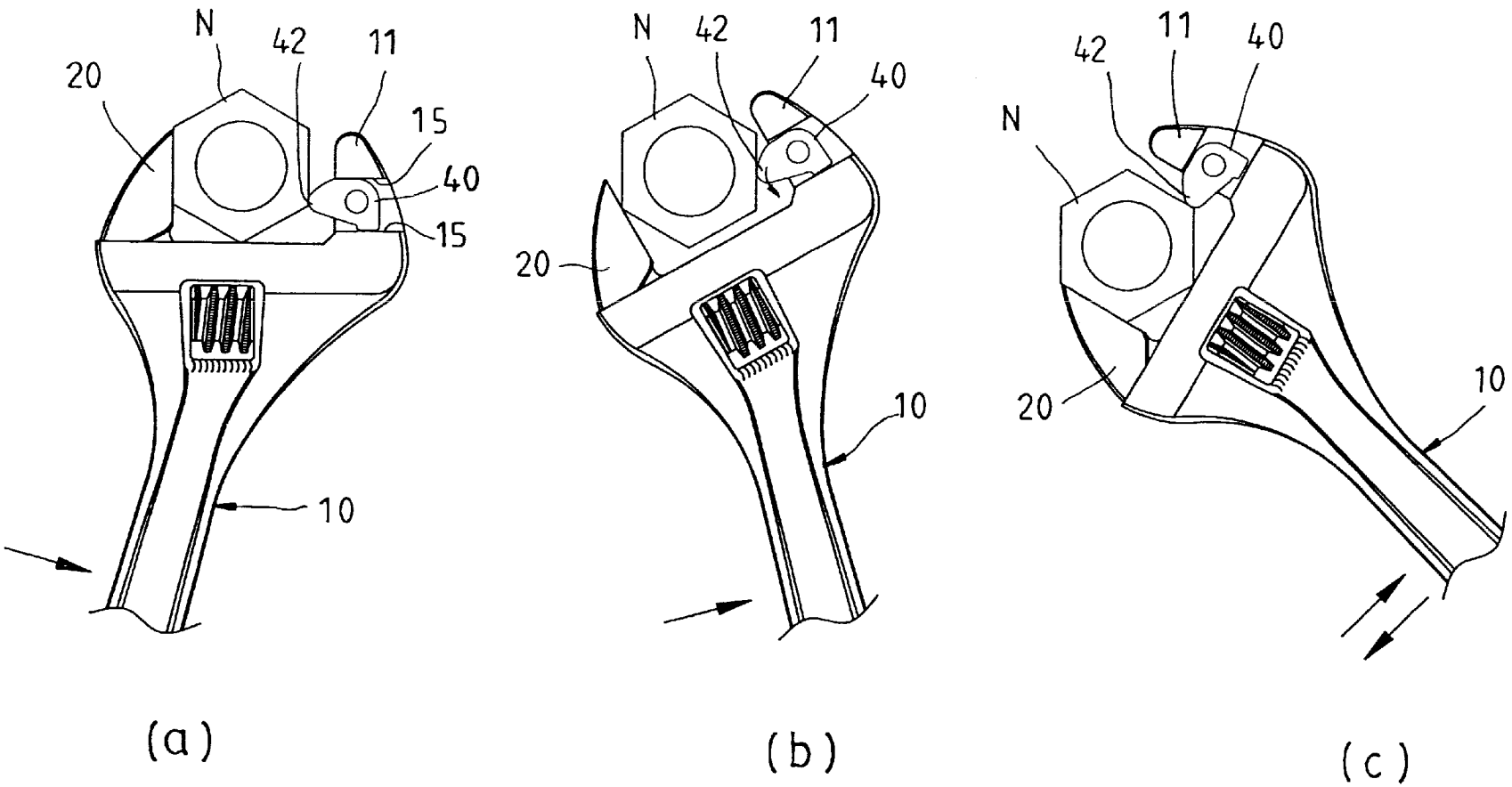
FIG. 6 shows the reversible adjustable wrench of the first prefer embodiment of the present invention turning reversibly, wherein FIG. 6*a* showing the wrench at initial position, FIG. 6*b* showing the wrench turning reversibly to 30 degrees and FIG. 6*c* showing the wrench turning reversibly to 60 degrees.

If user turns the adjustable wrench 1 reversibly, please refer to FIG. 5, the nut N will exert a force $F_b$ on the rotatable device 40. $F_b$ is resolved into a horizontal component $F_1$ and a vertical component $F_2$ too. The pin 46 will oppose $F_{1\ and\ F2}$ and will provide the rotatable device 40 a counterclockwise moment to make the holding portion 42 turn to the proximal end of the fixed jaw 11. Thus, please refer to FIG. 6*a* to FIG. 6*c*, the adjustable wrench 1 of the present invention can be turned reversibly and not drive the nut N to turn. When the adjustable wrench 1 is turned reversibly 60 degrees as shown in FIG. 6*c*, the user can then turn it clockwise again to drive the nut N to turn. Whereby, the adjustable wrench 1 of the present invention can drive a nut (or a bolt) to turn repeatedly without having to disengage and reengage the nut.

Figure 7:
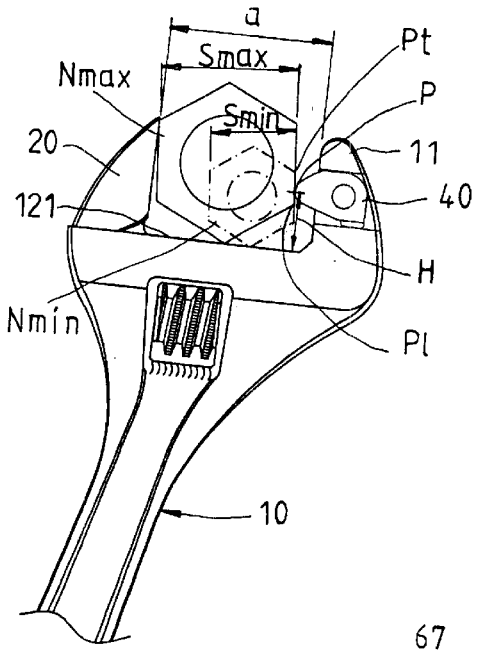
FIG. 7 is a front view of the first prefer embodiment of the present invention, showing the relative positions of a large nut and a small nut to the rotatable device.

As noted, the adjustable wrench 1 of the present invention permits the rotatable device 40 to be engaged against the lateral side of the nut. But the adjustable wrench is to drive nuts or bolts of different dimensions. So, the position of the rotatable device 40 is limited to a predetermined range. Please refer to FIG. 7, the holding portion 42 of the rotatable device 40 must locate between the top edge $P_t$ of the minimum nut $N_{min}$, which is the smallest nut to be turned, and the lower edge $P_1$ of the maximum nut $N_{max}$, which is the largest nut to be turned. So the height H of the rotatable device 40 between the sliding surface 121 and the point of the holding portion 42 touching the nut N is limited under the formula hereunder:

$$\frac{S_{\max}}{2} \times \tan 30^\circ < H < \frac{S_{\min}}{2} \times \tan 60^\circ$$

Wherein: $S_{min}$ is the dimension of the minimum nut to be turned $S_{max}$ is the dimension of the maximum nut to be turned Experience in manufacturing adjustable wrenches suggests that the position of the rotatable device 40 should be under the range defined in the table under:

| Size of adjustable wrench | Minimum nut (Smin) | Maximum nut (Smax) | Height of the rotatable device (H) | maximum distance of the fixed jaw and the movable jaw (A) | H/A |
|---|---|---|---|---|---|
| 100 | 6.2 | 12.4 | 3.6~5.4 | 13 | 0.28~0.41 |
| 150 | 9.3 | 18.7 | 5.4~8.1 | 19 | 0.28~0.42 |
| 200 | 9.3 | 23.7 | 6.9~8.1 | 24 | 0.29~0.34 |
| 250 | 12.3 | 28.0 | 8.1~10.7 | 28 | 0.29~0.38 |
| 300 | 12.7 | 33.0 | 9.5~11.0 | 34 | 0.28~0.32 |
| 375 | 15.3 | 41.5 | 12.0~13.3 | 43 | 0.28~0.31 |
| 450 | 17.7 | 50.7 | 14.6~15.3 | 52 | 0.28~0.29 |
| 600 | 23.0 | 58.8 | 17.0~19.9 | 62 | 0.27~0.32 |

The fifth column shows the minimum values of the maximum distances between the fixed jaw 11 and the movable jaw 20 of different size adjustable wrenches defined in ISO. The last column of the above table shows the ratio of the height of the rotatable device and the maximum distance of the fixed jaw 11 and the movable jaw 20 in adjustable wrenches of different sizes. Manufacturers can make the adjustable wrenches 1 disclosed in the present invention according to the table.

Figure 8:
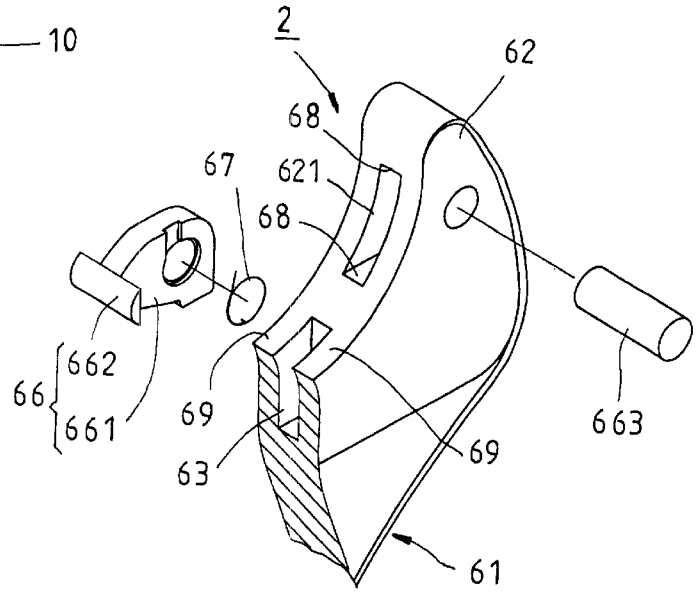
FIG. 8 is partial perspective view of a second prefer embodiment of the present invention, showing the rotatable device mounted on the fixed jaw.
Figure 9:
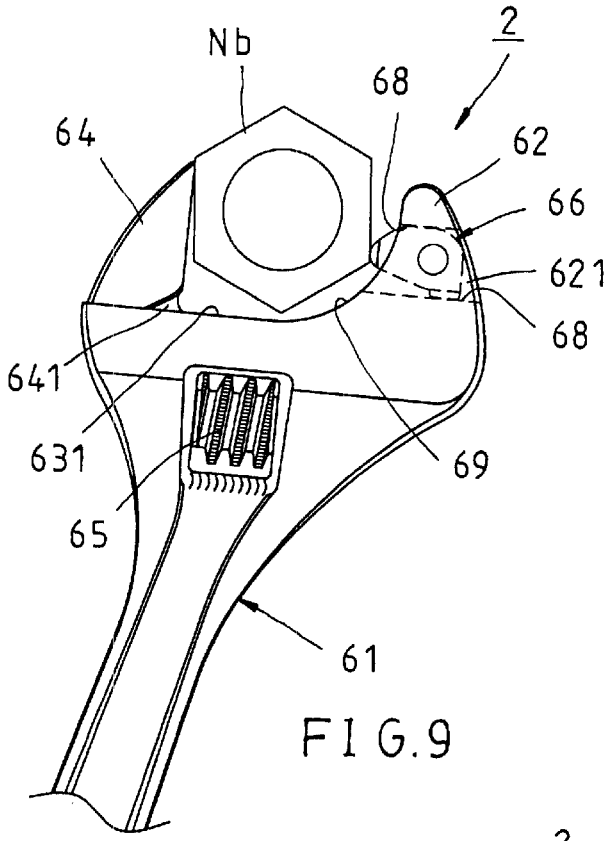
FIG. 9 is a partial front view of the second prefer embodiment of the present invention, showing the adjustable wrench turning a large nut.
Figure 10:
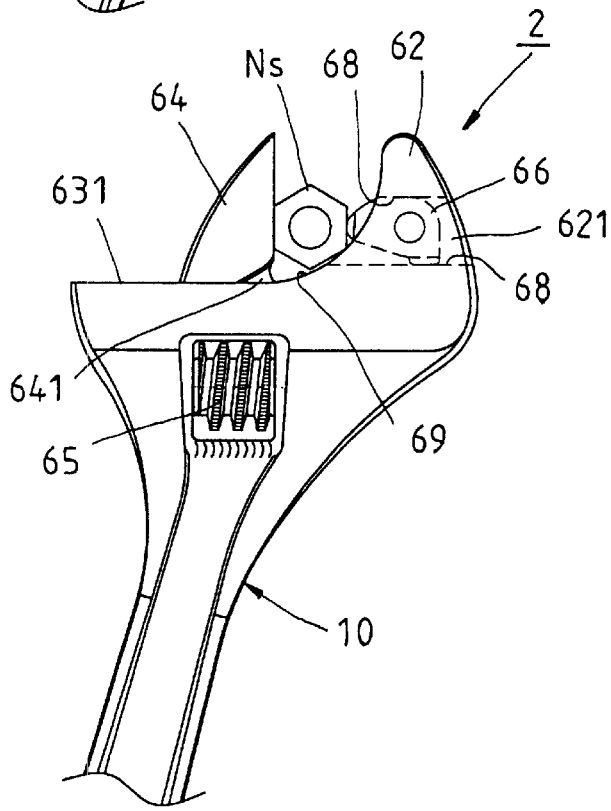
FIG. 10 is a partial front view of the second prefer embodiment of the present invention, showing the adjustable wrench turning a small nut.

Please refer to FIGS. from FIG. 8 to FIG. 10, the second prefer embodiment of the present invention provides an adjustable wrench 2, which comprises a handle 61 having a fixed jaw 62 and a guiding slot 63 at an end thereof, a movable jaw 64, an adjusting worm 65, a rotatable device 66 and an elastic member 67. The adjustable wrench 2 of the second prefer embodiment is similar to the adjustable wrench 1 of the first prefer embodiment, except that the rotatable device 66 of the second prefer embodiment is a T-shaped element, which has a body portion 661 and a holding portion 662 at an end of the body portion 661. The fixed jaw 62 has a through hole 621 for receiving the body portion 661 of the rotatable device 66 therein. A pin is inserted into the fixed jaw 62 and the body portion 661 for pivoting the rotatable device 66 on the fixed jaw 62. The opposite sidewalls of the through hole 621 define two stopping portions 68, which has the same functions as corresponding elements of the first prefer embodiment.

The second character of the adjustable wrench 2 of the second prefer embodiment provides two curved guiding tracks 69 extending from sliding surfaces 631 of the guiding slot 63 of the handle 61 to the fixed jaw 62. The movable jaw 64 has two gaps 641 corresponding to the guiding tracks 69 so that the movable jaw 64 can slide close to the fixed jaw 62 without interference with the guiding tracks 69.

Please refer to FIG. 9, which shows the adjustable wrench 2 of the second prefer embodiment engaging to a large nut Nb. The bottom edge of the nut $N_b$ is against the sliding surfaces 631, the movable jaw 64 and the holding potion 662 of the rotatable device 66 are against the lateral sides of the nut $N_b$ respectively in the same manner as the first prefer embodiment.

FIG. 10 shows the adjustable wrench 2 of the second prefer embodiment engaging to a small nut $N_5$. The nut is elevated by the guiding tracks 69, such that the holding portion 662 of the rotatable device 66 will engage a against the lateral side of the nut. This permits the adjustable wrench 2 of the second prefer embodiment of the present invention to turn nuts or bolts of different dimensions without having to limit the precise position of the rotatable device 66.

Figure 11:
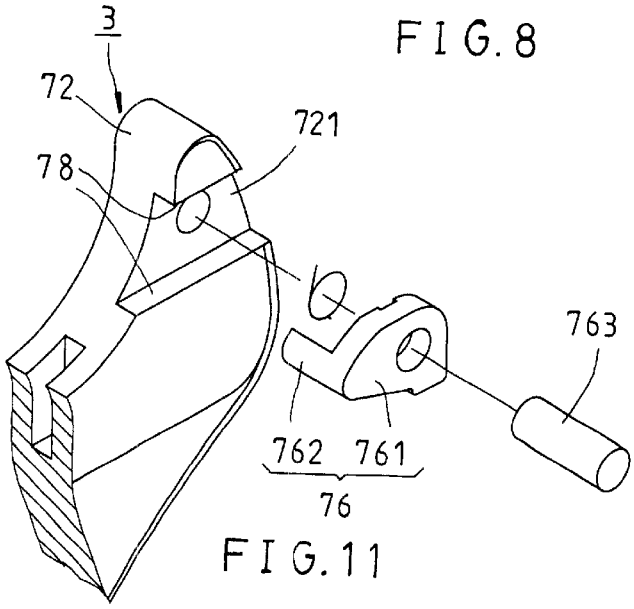
FIG. 11 is a partial perspective view of a third prefer embodiment of the present invention, showing the rotatable device mounted on the fixed jaw.

FIG. 11 shows an adjustable wrench 3 of the third prefer embodiment of the present invention, which is similar to the embodiments disclosed above, having a L-shaped rotatable device 76. The rotatable device 76 comprises a body portion 761 received in a slot 721 and a holding portion 762 at an end of the body portion 761. The slot 721 is disposed at a side of the fixed jaw 72, which defines the lateral sidewalls as stopping portions 78. The body portion 761 is received in the slot 721 and a pin passes through the body portion 761 and the fixed jaw 72 for pivoting the rotatable device 76 on the fixed jaw 72. The way of operating and the function of the adjustable wrench 3 of the third prefer embodiment is as the same the embodiments of disclosed above.

What is claimed is:

1. A reversible adjustable wrench for a turning nut, comprising:

a handle having a fixed jaw with a proximal end and a guiding slot at an end of said handle; two-sliding surfaces defined at the end of said handle beside an opening end of said guiding slot said fixed jaw having at least one stopping portion;

a movable jaw having an end thereof slidably received in said guiding slot of said handle;

an adjustable worm for driving said movable jaw toward and away from said fixed jaw;

a rotatable device pivoted at a point on said fixed jaw rotatable relative to said fixed jaw;

said rotatable device having a holding portion facing said movable jaw; and an elastic member disposed between said fixed jaw and said rotatable device which biases said holding portion of said rotatable device into an initial position against a tip end of said fixed jaw;

wherein, after the nut has been engaged between the fixed jaw and the movable jaw, the handle can be turned in a first direction to turn the nut while the holding portion remains in the initial position and in a second direction wherein said holding portion of said rotatable device is turned to the proximal end of said fixed jaw and the nut is not turned, wherein said fixed jaw has two slots at lateral sides thereof respectively, each slot having two said stopping portions at sidewalls thereof; said rotatable device having two substantially parallel body portions, said holding portion connecting ends of said body portions; said body portions of said rotatable device received in said slots of said fixed jaw respectively, and a pin inserted into said body portions and said fixed jaw for pivoting aid rotatable device on said fixed law.

2. A reversible adjustable wrench for a turning nut, comprising:

a handle having a fixed jaw with a proximal end and a guiding slot at an end of said handle; two-sliding surfaces defined at the end of said handle beside an opening end of said guiding slot; said fixed jaw having at least one stopping portion;

a movable jaw having an end thereof slidably received in said guiding slot of said handle;

an adjustable worm for driving said movable jaw toward and away from said fixed jaw;

a rotatable device pivoted at a point on said fixed jaw rotatable relative to said fixed jaw; said rotatable device having a holding portion facing said movable jaw; and an elastic member disposed between said fixed jaw and said rotatable device which biases said holding portion of said rotatable device into an initial position against a tip end of said fixed jaw;

wherein, after the nut has been engaged between the fixed jaw and the movable jaw, the handle can be turned in a first direction to turn the nut while the holding portion remains in the initial position and in a second direction wherein said holding portion of said rotatable device is turned to the proximal end of said fixed jaw and the nut is not turned, and wherein said fixed jaw has a through hole, which defines two said stopping portions at sidewalls thereof;

said rotatable device has a body portion and said holding portion connected to an end of said body portion;

said body portion of said rotatable device is received in said through hole of said fixed jaw, and a pin is inserted into said body portion and said fixed jaw for pivoting said rotatable device on said fixed jaw.

3. A reversible adjustable wrench for a turning nut, comprising:

a handle having a fixed jaw with a proximal end and a guiding slot at an end of said handle; two-sliding surfaces defined at the end of said handle beside an opening end of said guiding slot; said fixed jaw having at least one stopping portion;

a movable jaw having an end thereof slidable received in said guiding slot of said handle;

an adjustable worm for driving said movable jaw toward and away from said fixed jaw;

a rotatable device pivoted at a point on said fixed law rotatable relative to said fixed jaw; said rotatable device having a holding portion facing said movable jaw; and an elastic member disposed between said fixed jaw and said rotatable device which biases said holding portion of said rotatable device into an initial position against a tip end of said fixed jaw;

wherein, after the nut has been engaged between the fixed jaw and the movable jaw, the handle can be turned in a first direction to turn the nut while the holding portion remains in the initial position and in a second direction wherein said holding portion of said rotatable device is turned to the proximal end of said fixed jaw and the nut is not turned, and wherein said fixed jaw has a slot at a side thereof, said slot defines two said stopping portions at sidewalls thereof; said rotatable device has a body portion and a holding portion connected to an end of said body portion; said body portion of said rotatable device is received in said slot of said fixed jaw, and a pin inserted into said body portion and said fixed jaw for pivoting said rotatable device on said fixed jaw.

4. A reversible adjustable wrench for a turning nut, comprising:

a handle having a fixed jaw with a proximal end and a guiding slot at an end of said handle; two-sliding surfaces defined at the end of said handle beside an opening end of said guiding slot; said fixed jaw having at least one stopping portion;

a movable jaw having an end thereof slidable received in said guiding slot of said handle;

an adjustable worm for driving said movable jaw toward and away from said fixed jaw;

a rotatable device pivoted at a point on said fixed jaw rotatable relative to said fixed jaw; said rotatable device having a holding portion facing said movable jaw; and an elastic member disposed between said fixed jaw and said rotatable device which biases said holding portion of said rotatable device into an initial position against a tip end of said fixed jaw; wherein after the nut has been engaged between the fixed jaw and the movable jaw, the handle can be turned in a first direction to turn the nut wherein the holding portion remains initial position and in a second direction wherein said holding portion of said rotatable device is turned to the proximal end of said fixed jaw and the. nut is not turned, wherein the ratio of a distance (H) between a top of said two-sliding surfaces and a front end of said holding portion in the initial position thereof of said rotatable device and a maximum distance between said fixed jaw and said movable jaw of the adjustable wrench is within a range of 0.27 to 0.42.

* * * * *